United States Patent [19]

Smith

[11] Patent Number: 4,550,537

[45] Date of Patent: Nov. 5, 1985

[54] MONUMENTS FOR GRAVES

[76] Inventor: Wallace R. Smith, 76 University St., Portland, Me. 04103

[21] Appl. No.: 504,812

[22] Filed: Jun. 16, 1983

[51] Int. Cl.[4] ..... E04H 13/00

[52] U.S. Cl. ..... 52/103

[58] Field of Search ..... 52/103, 104; 40/124.5; D99/17, 18; 411/910

[56] References Cited

U.S. PATENT DOCUMENTS

| | | | |
|---|---|---|---|
| 221,969 | 11/1879 | McMinn | 52/103 |
| 498,506 | 5/1893 | Cameron | 40/124.5 |
| 1,830,836 | 11/1931 | Hager | 52/103 |
| 2,274,192 | 2/1942 | Deaton | 40/124.5 |
| 2,525,091 | 10/1950 | Brownawell . | |
| 4,018,111 | 4/1977 | Goldhaber | 411/910 |
| 4,171,662 | 10/1979 | Simone | 411/910 |

FOREIGN PATENT DOCUMENTS

| | | | |
|---|---|---|---|
| 2052590 | 1/1981 | United Kingdom | 52/103 |

*Primary Examiner*—John E. Murtagh

[57] ABSTRACT

A monument for a grave consists of a head and a base both of stainless steel with the head welded to the base and provided with a recess in its front face for an insert engraved with identifying date and clamped in the recess by fastening means exposed on the rear surface of the head. The monument is connected to a concrete anchor by a member or members secured to the undersurface of the base when embedded in the concrete during the installation of the monument. The thickness of both the head and base is not less than five-eighths of an inch and not more than two inches.

1 Claim, 8 Drawing Figures

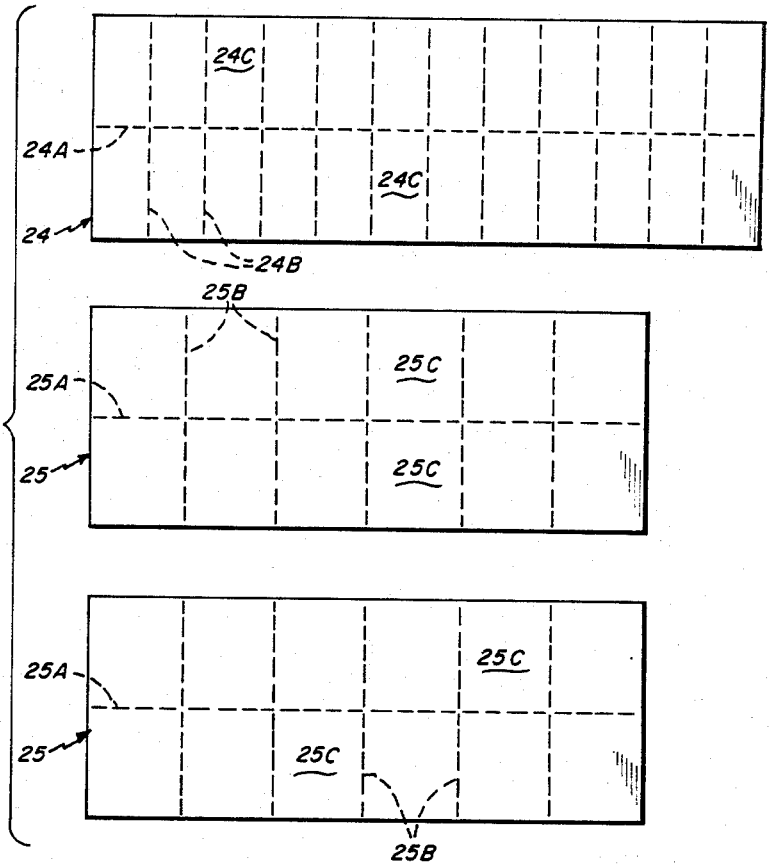
Fig. 4
Fig. 8
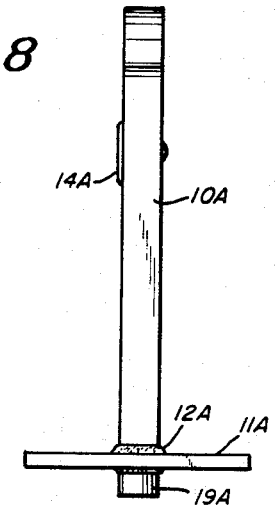

MONUMENTS FOR GRAVES

BACKGROUND REFERENCES

U.S. Pat. No. 1,531,754;
U.S. Pat. No. 1,624,048;
U.S. Pat. No. 2,068,830;
U.S. Pat. No. 2,084,521;
U.S. Pat. No. 2,095,290;
U.S. Pat. No. 2,525,091;
U.S. Pat. No. 3,438,159.

BACKGROUND OF THE INVENTION

Monuments for graves have traditionally been of stone and over the years have varied greatly as to sizes and shapes but, at the present time, most monuments are relatively uniform as to their overall dimensions.

There are objections to stone monuments such as their costs, weight and their susceptability to movement by frost and, in addition, vandalism, while varying from one locale to another, is unfortunately sufficiently widespread to be of concern.

THE PRESENT INVENTION

The general objective of the present invention is to provide stainless steel monuments that combine appearance, cost, and weight factors and the assurance of a stable, service-free installation making them more than competitive with stone monuments of approximately the same shape and size.

In accordance with the invention, the general objective is attained with each monument consisting of a head and base of stainless steel preferably having mill finishes with the thickness of each not less than five-eighths of an inch but nor more than two inches and with the preferred thickness rage five-eighths to one and one-quarter inches.

Each head has a recess in its front surface for an insert engraved with identifying date and is secured to the base by a continuous weld. It is preferred that the insert be removable and to that end provision is made to enable each to be clamped in the recess by releasable but usually vandal resistant means exposed at the back of the head.

During the installation of a monument in accordance with the invention, the monument is connected to concrete anchoring means by means secured to the undersurface of the base and embedded in the concrete anchoring means which extend into the ground to a depth preventing movement by frost or vandals. While the connecting means may be secured to the base prior to transportation of the monument to the cemetery, it is preferred that only a short part or parts thereof be then attached and that such part or parts be of a type permitting the easy attachment thereto of the remainder of the connecting means as by threaded or pinned junctions by way of examples and not of limitation. The cross sectional area of the concrete anchoring means is preferably less than that of the base to minimize the amount of dirt to be removed and the amount of concrete required to provide anchoring means that cannot be lifted or turned without such power operated equipment as a fork lift.

PRIOR ART STATEMENT

Of the cited patents, both Pat. No. 2,521,091 and No. 2,084,521 were made of stainless steel. Each disclosed head sections and base sections in the form of stainless steel sheets with the base section partly filled with concrete and partly embedded in the ground. In the first named patent, the two shells were bolted together while in the second, the sections were joined by a weld. In both instances, the constructions were open to the objection that warping would unavoidably result in the fabrication.

The Pat. No. 2,095,290 is cited as illustrating anchorage of a marker in the form of a metal plaque substantially flush with the ground. A large concrete body had drain passageways through which the anchors extended with the anchors caught by the bottom ends thereof. While the plaque was securely anchored, it was not removable.

The remaining citations show plaques and other attachments provided with identifying indicia with attaching means extending therethrough and anchored in the heads of the monuments.

BRIEF DESCRIPTION OF THE DRAWINGS

The accompanying drawings illustrate preferred embodiments of the monuments for graves and of their production

FIG. 4 is a plan view of stainless steel sheets with the blanks indicated that are required for the production of twenty-four monuments, the heights and widths of the heads and bases of which do not exceed maximum dimensions;

FIG. 8 is a like view of a completed monument with the head thicker than the base.

THE PREFERRED EMBODIMENT OF THE INVENTION

Figure 1:
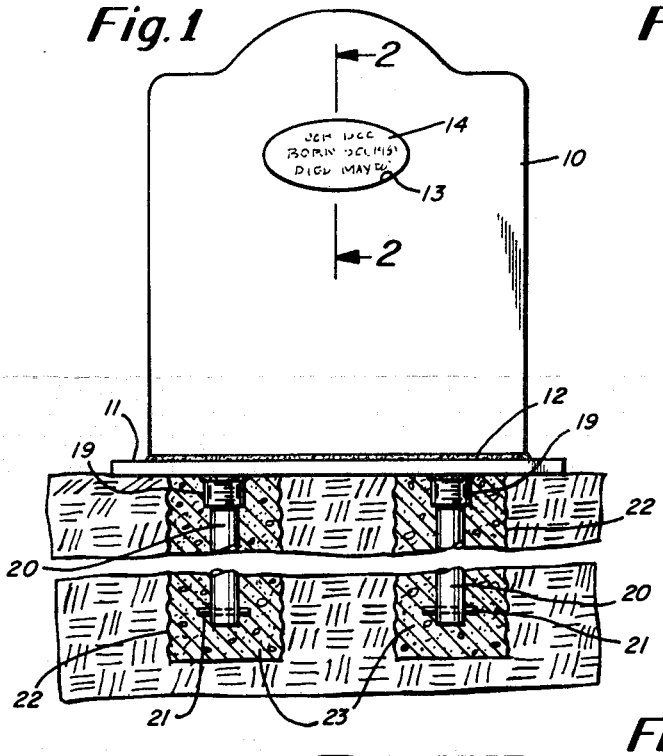
FIG. 1 is a front view of an installed monument.
Figure 2:
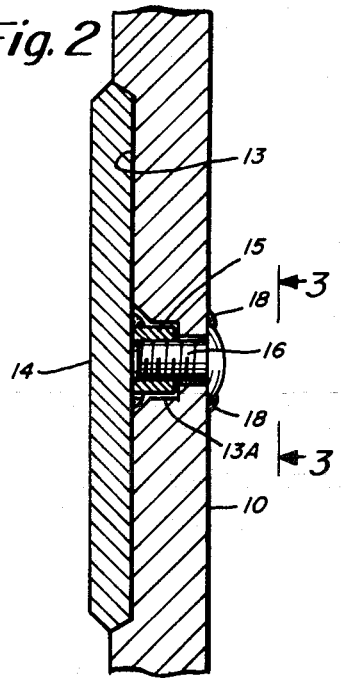
FIG. 2 is a section, on an increase in scale, taken approximately along the indicated line 2—2 of FIG. 1.
Figure 3:
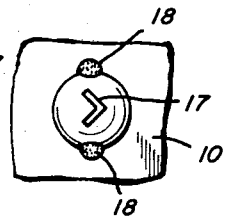
FIG. 3 is a rear view of that portion of the monument shown in FIG. 2.

In FIG. 1, a monument for a grave is shown as installed with the monument consisting of a solid, stainless steel head 10 secured centrally of the upper surface of a solid stainless steel base 11 by a continuous weld 12. Low carbon stainless steel such as #304L and preferably having a mill finish is employed for both the head and the base with the thickness of the sheets from which the heads and bases are formed in the approximate range of five-eighths to two inches with the preferred range five-eighths to one and one-quarter inches.

The head 10 has a shallow, regular recess 13 in its front surface with at least one hole 14 drilled centrally thereof opening through the rear wall. A bronze or stainless steel insert 14, of a size and shape to fit the recess 13, is shown as provided with a single threaded socket 15 on its rear surface. A bolt 16 is threaded into the socket through the rear surface of the head 10 with the bolt head dimensioned to seat tightly against said surface as it is turned to seat the insert 14 tightly in the recess 13. The insert 14 is provided, preferably before its attachment to the head, with engraved data relative to the deceased and, as described, it is removable in order that such data may be updated where the engraving may be accurately done. Unauthorized removal is made difficult by providing a kerf 17 in the bolt head 16 requiring a special tool to turn the bolt and in addition tack welds 18 are also preferably employed. By way of example and not of limitation left hand threading may be employed with the kerf shaped to invite turning in the opposite direction for bolt removal.

Such monuments are considerably lighter in weight than conventional stone monuments of substantially the same size and shape but differing as to head and base thicknesses. For example, a monument with both the head and base of five-eighths stock may well have a weight approximately one-fifth that of the corresponding stone monument.

It is accordingly essential that such stainless steel monuments be well anchored against unauthorized removal and to prevent their positions from being adversely affected by frost. To that end, concrete anchoring means are used with an installed monument secured by connecting means attached to the undersurface of the base and embedded to a wanted depth in the concrete. It is preferred that only a minor portion of the connecting means be secured to the undersurface of the bases prior to their transportation to cemeteries and that the remainder of the connecting means be there added.

One preferred example of connecting means is illustrated by the drawings in which there are two connecting means with the minor portion of each consisting of a threaded socket 19 secured to the bottom surface of the base 11 in spaced relation to the other and the ends and sides of the base. The major portion of the connecting means may be of lengths of galvanized iron pipe 20 having threaded upper ends with their lower ends provided with transverse members 21. The pipe stock may be one and one-half inches in diameter and the lengths are typically four feet in length in order to insure anchorage when embedded in the anchoring means which are shown as tubular forms 22, filled with concrete 23, four feet long and in the order of six inches in diameter, one concrete filled form for each connecting means. It will be noted that such anchoring means require the removal of a minimum amount of dirt and the use of a relatively small amount of concrete and that the cross sectional area of the anchoring means less than that of the base.

Figure 7:
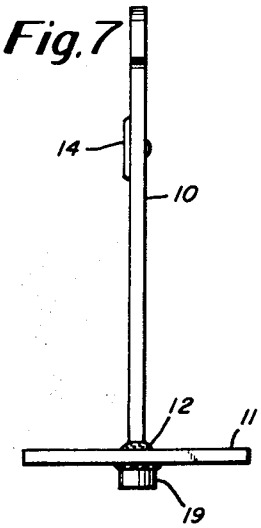
FIG. 7 is a side view of a completed monument with the base and head of the same thickness.

The heads and bases may be of the same thickness as will be apparent from FIG. 7. They may also be of different thicknesses with the monument illustrated by FIG. 8 having its head 10A of maximum thickness and its base 11A of minimum thickness by way of an example.

The trend towards monuments the bases and heads of which are within a fairly close range of maximum dimensions enables monuments in accordance with the invention to be produced economically in accordance with the following method described in terms of the production of bases and heads for twenty-four monuments.

In accordance with the method, see FIG. 4, three commercially available stainless steel sheets are employed, one sheet 24 that is four feet by twelve feet and two sheets 25 that are four feet by ten feet. The several sheets may be of the same or different thicknesses.

The sheet 24 when cut lengthwise along the center line 24A and crosswise along lines 24B spaced one foot apart provides twenty-four blanks 24C for bases that are one foot in width and two feet in length.

The sheets 25, when both are cut along center lines 25A and transverse lines 25B spaced twenty inches apart provide twenty-four blanks 25C for heads that are twenty inches in width and two feet in height.

Figure 5:
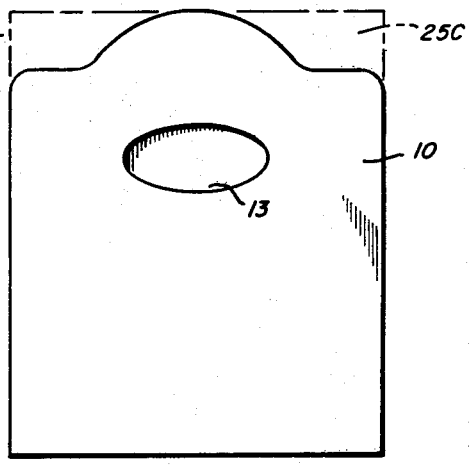
FIG. 5 is a plan view of a head completed from a head blank.
Figure 6:
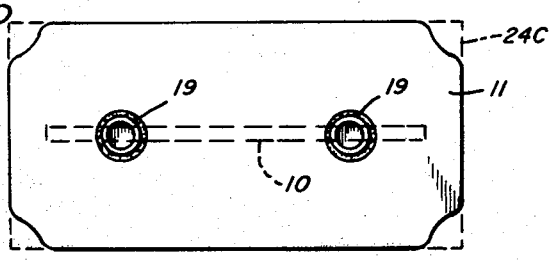
FIG. 6 is a plan view of a base completed from a base blank.

Each head blank 25C may be then cut to provide a head 10 of a wanted shape with that shown in FIG. 5 illustrating a conventional shape established with minimum waste. Each base blank 24C may be cut to provide a base 11 of a wanted shape with that shown in FIG. 6 also representing a satisfactory shape established with minimum waste. A head is completed by forming a recess 13 of a wanted shape in the front face thereof and then completing the monument by welding sockets 15 to the undersurface of the base 11 and welding the head 10 to the base 11.

Monuments in accordance with the invention are consistent in appearance to conventional stone monuments but are less expensive and lighter in weight than stone monuments of the same shape and size (with differences in thickness of the heads not a detracting factor). In addition, monuments, once installed, are stable against the effects of frost and efforts of vandals to injure or remove them although they can be readily removed as by fork lifts. As the bases, particularly those within the preferred range are so nearly flush with the ground that wheels of mowers can readily ride over their margins.

I claim:

1. A monument for graves, said monument including a base and a head each of which consists of a single flat sheet of stainless steel the thickness of which is in the approximate range of five-eighths of an inch to two inches, the length and width of the base greater than the width and thickness of the head, a weld joining the head and the base and extending continuously about the head with said head normal to the base and so located that marginal portions of the base are exposed on both sides of and at both ends of the head, a concrete support in the ground in the ground in the form of a pair of tubular forms in the ground and of a diameter less than the width of the base and spaced lengthwise thereof, a body of concrete in each form, and said base including a connecting means depending from and secured to its undersurface and embedded and anchored in a selected one of said concrete filled forms in a manner such that the monument is installed with said base substantially flush with the ground surrounding the monument, whereby the wheels of a lawn mower may travel across marginal portions of the base while the mower is cutting grass at the edges thereof.

* * * * *